United States Patent [19]

Detournay et al.

[11] Patent Number: 4,800,008

[45] Date of Patent: Jan. 24, 1989

[54] ELECTROLYSER OF THE FILTER-PRESS TYPE

[75] Inventors: Jean-Paul Detournay, Franiere; Emile Cabaraux, Brussels, both of Belgium

[73] Assignee: Solvay & Cie., Brussels, Belgium

[21] Appl. No.: 68,842

[22] Filed: Jul. 1, 1987

[30] Foreign Application Priority Data

Jul. 9, 1986 [FR] France ..... 86 10143

[51] Int. Cl.[4] ..... C25B 9/00; C25B 9/02

[52] U.S. Cl. ..... 204/253; 204/279; 204/286

[58] Field of Search ..... 204/253–258, 204/263–266, 279, 286, 297 R

[56] References Cited

U.S. PATENT DOCUMENTS

| | | | |
|---|---|---|---|
| 4,256,562 | 3/1981 | Mose et al. | 204/258 |
| 4,402,813 | 9/1983 | Kircher et al. | 204/279 |
| 4,439,298 | 3/1984 | Ford et al. | 204/258 |
| 4,490,231 | 12/1984 | Boulton | 204/263 |
| 4,605,482 | 8/1986 | Shiragami et al. | 204/258 |
| 4,654,134 | 3/1987 | Morris et al. | 204/253 X |
| 4,695,359 | 9/1987 | Woodard, Jr. et al. | 204/279 X |

FOREIGN PATENT DOCUMENTS

| | | |
|---|---|---|
| 0080287 | 6/1983 | European Pat. Off. . |
| 0080288 | 6/1983 | European Pat. Off. . |
| 1593242 | 7/1970 | France . |

*Primary Examiner*—Donald R. Valentine

*Attorney, Agent, or Firm*—Robert E. Burns; Emmanuel J. Lobato

[57] ABSTRACT

The electrolyser comprises vertical electrodes (8, 9) and a stack of vertical frames (1, 2) made of a flexible material, deployed freely over the periphery of the electrodes and elastically deformed by compression one against another between two end flanges (3, 4).

The invention applies to membrane electrolysers for the electrolysis of aqueous sodium chloride solutions.

11 Claims, 13 Drawing Sheets

ELECTROLYSER OF THE FILTER-PRESS TYPE

The invention relates to an electrolyser of the filter-press type.

Electrolysers of the filter-press type generally consist of a stack of vertical frames which define electrolysis chambers in which electrodes are arranged vertically. Membranes with selective permeability or diaphragms which are permeable to the electrolytes may be inserted between the consecutive frames, to separate the electrolysis chambers.

The particular feature of known electrolysers of this type is that they generally consist of a stack of units made of different materials. Thus, document BE-A-No. 858,100 (Diamond Shamrock Corporation) describes an electrolyser which consists of a stack of rigid metal frames and of membranes with selective permeability; seals are inserted between the frames and the membranes, and electrodes are housed in the chambers defined by the frames and the membranes. Documents EP-A-No. 80,287 and EP-A-No. 80,288 (Imperial Chemical Industries PLC) describe an electrolyser consisting of a stack of metal plates serving as electrodes and of membranes with selective permeability; seals made of a flexible material are inserted between the plates and the membranes.

In these known electrolysers, the alternation of a number of units made of different materials makes their construction difficult and is detrimental to their leakproofing.

French Patent FR-A-No. 1,593,242 described a fuel cell consisting of a stack of rubber electrode-carrier units, each electrode-carrier consisting of an annular rubber frame which encloses several electrodes and several separators. In this known fuel cell the electrodes oppose a local distortion of the annular frames, because they are held by being enclosed or clamped in the latter. When the cell is being assembled, compression of the frames, which is necessary for leakproofing, consequently gives rise to high internal stresses in the frames and the electrodes, which are liable to crack the frames and distort the electrodes.

The invention offers a remedy to these disadvantages by providing an electrolyser of the filter-press type, of novel design, in which the number of different stack units is reduced and whose construction is made easier and whose sealing is improved without giving rise to excessive stresses in the frames and the electrodes.

Consequently, the invention relates to an electrolyser of the filter-press type, comprising a stack of vertical frames defining electrolysis chambers containing vertical electrodes; according to the invention, the frames are made of a flexible material, are deployed freely on the periphery of the electrodes and are elastically deformed by compression against one another, between two end flanges.

In the electrolyser according to the invention, the frames are made of a flexible material, deformable elastically by compression. In general, their rigidity may be insufficient for them to retain their profile in vertical position, so that they naturally sag onto themselves under the effect of their own weight. They are generally made of an elastomeric material whose Shore A hardness (defined by the ASTM standard D2240-75) is between 40 and 90 units, preferably between 50 and 80 units. The choice of the frame material is conditioned, moreover, by their need to withstand adequately the chemical and thermal conditions which normally prevail in the electrolyser when it is in operation. Elastomeric copolymers derived from ethylene and propylene are suitable in the case of electrolysers for the production of chlorine and of aqueous sodium hydroxide solutions by electrolysis of aqueous sodium chloride solutions. Preferred examples of such copolymers are those referred to as EPM, which are copolymers of ethylene and propylene containing between 25 and 60% of propylene, and those referred to as EPDM, which are terpolymers of ethylene, propylene and a diene which contains uncongugated double bonds.

The frames may have any profile which is compatible with the implementation of the electrolysis chambers, for example a circular, oval, rectangular or polygonal profile. In accordance with the invention, they are deployed at the periphery of the electrodes which, because of their rigidity, form a supporting structure for the frames. The electrodes should accordingly have a profile and dimensions which are compatible with the profile and dimensions of the frames, so that they fit the opening defined by the frames and then give them a stable profile. For example, they may consist of full or perforated, planar or corrugated metal plates, rods or horizontal or vertical metal strips. They should be sufficiently rigid to support the frames in a vertical position without distorting.

In the electrolyser according to the invention, the frames straddle the electrodes over their entire periphery and freely surround the periphery of the electrodes. They may rest freely on the periphery of the electrodes without being integrally attached thereto.

According to the invention it is immaterial whether a frame in the stack is deployed over several electrodes or whether several consecutive frames are deployed together over the same single electrode. It is generally preferred to associate an individual frame with each electrode.

According to the invention, the stack frames are compressed one against another between two end flanges which thus serve as nondeformable vertical supports for the stack of frames. As a general rule, the compression is adjusted so that the frames are sufficiently elastically deformed to ensure leakproofing of the stack. The optimum value of the compression depends on the material of construction of the frames and must be determined in each particular case. The compression may be produced by an appropriate means, for example by means of tie rods connecting the flanges to each other.

In the electrolyser according to the invention, the end flanges may be closing panels of the electrolyser. In an alternative embodiment, they may be profiled so as to define an electrolysis chamber or an electrolyte circulation chamber.

The electrolyser according to the invention is generally placed on a base which may, for example, be a pedestal in concrete or in masonry or a framework of metal beams, stationary or movable on a rolling track.

The invention applies equally well to bipolar electrolysers and to monopolar electrolysers.

The electrolyser according to the invention is generally provided with lines for the entry and the removal of the substances taking part in the electrolysis. These lines may advantageously be formed by the juxtaposition of tubular sections arranged in the stack frames, as described in document EP-A-No. 80,287.

In a particular embodiment of the electrolyser according to the invention, the latter comprises devices for centring the electrodes in their respective frames. The centring devices should be designed so as to restrict to a minimum their hindrance to the free deformation of the frames when the latter are compressed one against another to form the electrolyser wall. To this end, according to the invention, they may include members for fastening the electrodes locally to the frames, which are arranged at intervals on the periphery of the frames, so that the frames can deform freely, without hindrance, between two successive fastening members. As a general rule, it is desirable to reduce the number of local fastening members strictly to the minimum required to ensure centring of the electrodes in the frames. For example, in the case of square or rectangular frames, four local fastening members may be provided, distributed uniformly over the periphery of the frames; they are advantageously distributed to give two fastening members along each vertical upright of the frame. The fastening members may, for example, comprise tenons which are fixed to the electrodes and are engaged in corresponding slots made in the frames. In an alternative embodiment, the frames comprise side tenons which rest on corresponding supports fixed to the electrodes. Four tenon-slot or tenon-support pairs may advantageously be provided on the periphery of the frame in order to centre the electrode in the frame.

This embodiment of the invention finds an advantageous application in electrolysers of the monopolar type, in which the electrodes are individually attached to electrical conductors which pass in a leakproof manner through cylindrical openings provided through the frames, in order to be connected to bus bars arranged outside the electrolyser. According to the invention, the electrical conductors are used as members for locally fastening the electrodes to the frames and consist, for this purpose, of rigid metal bars whose cross-section is preferably circular or oval. Sealing of the passage of the bars through the corresponding cylindrical openings in the frame may be produced by elastic clamping of the bars in their cylindrical openings and/or by means of a coating inserted between the bars and the cylindrical wall of the openings. The sealing may be reinforced by means of sealing lips fixed to the frame, in the manner shown in FIG. 4 of Patent FR-A-No. 1,593,242.

In another particlar embodiment of the electrolyser according to the invention, the respective dimensions of the frames and of the electrodes are adjusted so as to provide a substantial gap between at least a part of the peripheral edge of the electrodes and the frames. In the case of square or rectangular frames and electrodes, for example, use is made of electrodes whose height and width are smaller than the height and the width, respectively, of the rectangular opening in the corresponding frame. This embodiment of the invention further reduces hindrances to the local deformations and displacements of the frames during the assembly of the electrolyser and its operation. To this end, it is recommended that the gap between the peripheral edge of the electrodes and the frame should be sufficient in order that, during the assembly of the electrolyser and its operation, the frames should be capable of swelling transversely without being hindered by the electrodes or, where appropriate, without the internal tensile and compressive stresses which might be produced in the frames and in the electrodes respectively exceeding a critical threshold, the latter being defined, for example, by the elastic limit of the material of construction of the frames and by the buckling strength of the electrodes. In practice, the optimum gap to be provided between the frames and the electrodes depends on a number of parameters which include, in particular, the profile and the dimensions of the frames and of the electrodes, the material of construction of the frames, especially its elasticity modulus, and the forces of compression of the frames one against another between the end flanges. It should be determined by a routine calculation in each individual case.

In an additional embodiment of the electrolyser according to the invention, the flanges are placed on the pedestal, the electrodes are supported by the frames, and the frames are supported above the pedestal by frictional forces generated between the frames and the flanges. This embodiment of the invention permits local deformations and displacements of the stack frames, particularly under the effect of local variations in pressure or temperature in the electrolysis chambers. This embodiment of the invention is well adapted to small electrolysers, comprising a limited number of frames, for example fewer than 50 consecutive frames. In an alternative form, in the case of large electrolysers comprising a large number of flexible frames, for example more than 100, it may be found convenient to provide one or more local supports under the stack of frames.

In a modified embodiment of the electolyser according to the invention, the frames are suspended from the electrodes, and the latter are fastened to rigid electrical conductors which pass through the frames in a leakproof manner and are carried on a suitable support. In this embodiment of the electrolyser according to the invention, the electrical conductors play a double role: on the one hand, they serve as an electrical connection between the electrodes and a source of direct current; on the other hand, they serve as a supporting means of the electrodes and frames.

The invention improves the imperviousness of the filter-press type electrolysers comprising a stack of frames, in that it allows deformable frames of optimum flexibility to be chosen and compressed at will against one another. it is advantageously adapted to the construction of electrolysers in which the anode chambers are isolated from the cathode chambers by separators which are permeable to ions. As a general rule the separators can be sheets which are interposed between the successive frames of the stack and made of a material which can permit an ion stream to cross it during the operation of the electrolyser. For this purpose they may be either diaphragms which are permeable to aqueous electrolytes or selective permeability membranes.

Examples of diaphragms which may be employed in the electrolyser according to the invention are asbestos diaphragms, such as those described in the U.S. Pat. No. 1,855,497 (Stuart), British patent No. 2,003,182 (Solvay & Cie) and U.S. Pat. No. 4,204,941 (assigned to Solvay & Cie) and organic polymer diaphragms, such as those described in U.S. Pat. No. 3,890,417 (assigned to Imperial Chemical Industries Ltd) and in European Pat. Nos. 7,674 and 37,140 (Solvay & Cie).

A selective permeability membrane is understood to be a thin, non-porous membrane incorporating an ion exchanger substance. The choice of the material forming the membrane and of its ion exchanger substance will depend on the nature of the electrolytes subjected to electrolysis and the products which it is intended to obtain. As a general rule, the membrane material is chosen from among those which are capable of withstanding the thermal and chemical conditions normally existing in the electrolyser during the electrolysis, the ion exchanger substance being chosen from among substances which exchange anions or substances which exchange cations, depending on the electrolysis operations for which the electrlyser is intended. For example, in the case of electrolysers intended for the electrolysis of aqueous sodium chloride solutions for the manufacture of chlorine, hydrogen and aqueous sodium hydroxide solutions, membranes which are highly suitable are cationic membranes of a fluorinecontaining polymer, preferably perfluorinated, containing functional cationic groups derived from sulphonic acids, carboxylic acids or phosphonic acids, or mixtures of such functional groups. Examples of membranes of this type are those described in British Pat. Nos. 1,497,748 and 1,497,749 (ASAHI KASEI KOGYO K.K.), 1,518,387 and 1,522,877 (ASAHI GLASS COMPANY Ltd.) and 1,402,920 (DIAMOND SHAMROCK CORP.) and in US patent 4,126,588 (assigned to ASAHI GLASS COMPANY Ltd.).

Membranes which are particularly suitable for this application of the electrolyser according to the invention are those known under the names "NAFION" (DU PONT DE NEMOURS & Co) and "FLEMION" (ASAHI GLASS COMPANY Ltd.).

The electrolyser according to the invention can advantageously be used for the manufacture of chlorine and aqueous solutions of sodium hydroxide by electrolysis of aqueous solutions of sodium chloride.

An advantage of the electrolyser according to the invention consists in that the leaktight sealing of the filter-press type electrolysers is now improved and made easier. Indeed in the electrolyser according to the invention a leaktight sealing of the stack of frames and membranes can be obtained easily by an elastic compression of the frames, without the need of extra seals between the frames and membranes or of a cementing, welding or otherwise sealing of the frames and membranes together. However an extra welding or sealing of the frame in addition to the compression does not come out of the invention.

Features and details of the invention will become apparent from the following description of several particular embodiments of the electrolyser according to the invention, with reference to the attached drawings.

In these figures, the same reference numbers denote identical elements.

Figure 1:
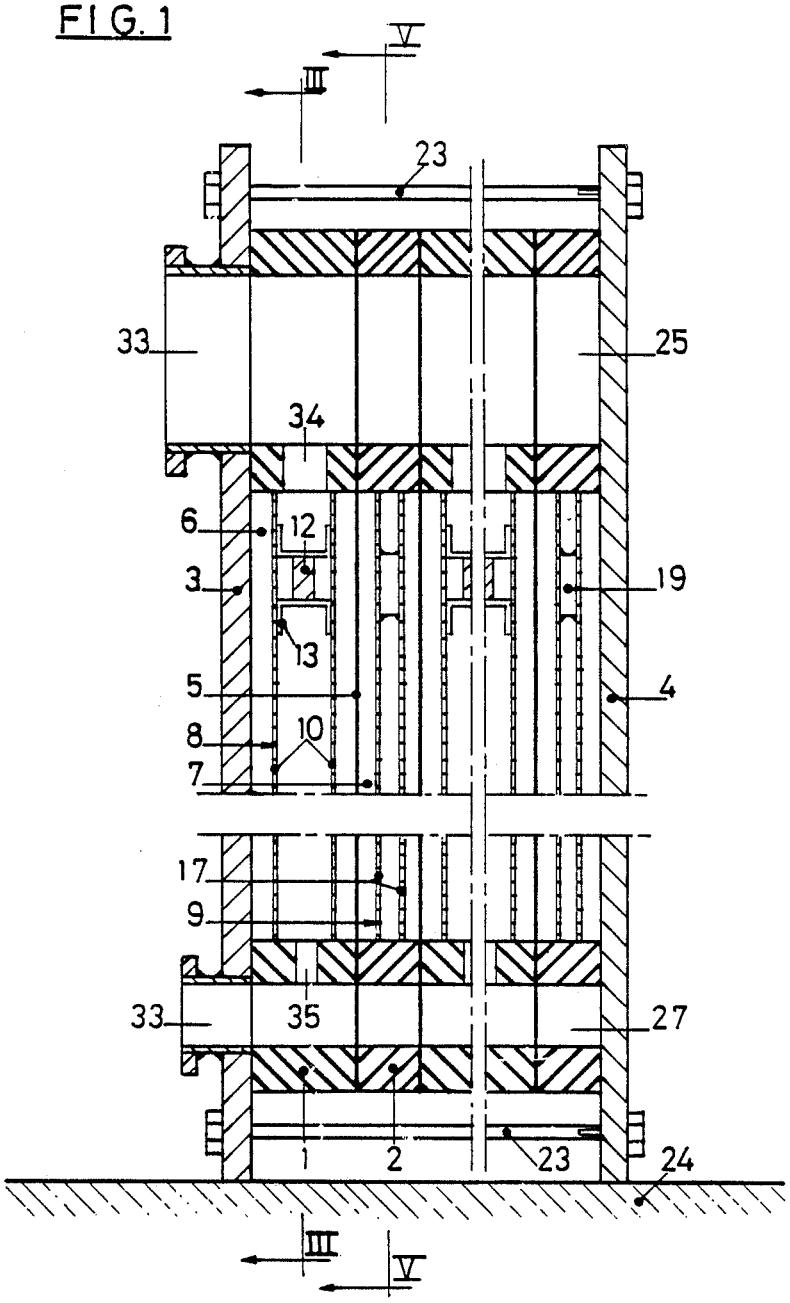
FIG. 1 shows a first embodiment of the electrolyser according to the invention, in vertical lengthwise section.

The electrolyser shown in FIG. 1 consists of a stack of vertical frames, alternately anodic 1 and cathodic 2, between two rigid end flanges 3 and 4, on a pedestal 24. Membranes with selective permeability 5 are inserted between the frames 1 and 2 to define alternately anodic 6 and cathodic 7 electrolysis chambers containing anodes 8 and cathodes 9 respectively.

In accordance with the invention, the anode frames 1 and cathode frames 2 are made of an elastomeric material characterized by a Shore A hardness of less than 50 units, for example a copolymer derived from ethylene and propylene such as those referred to as EPM and EPDM.

Figure 2:
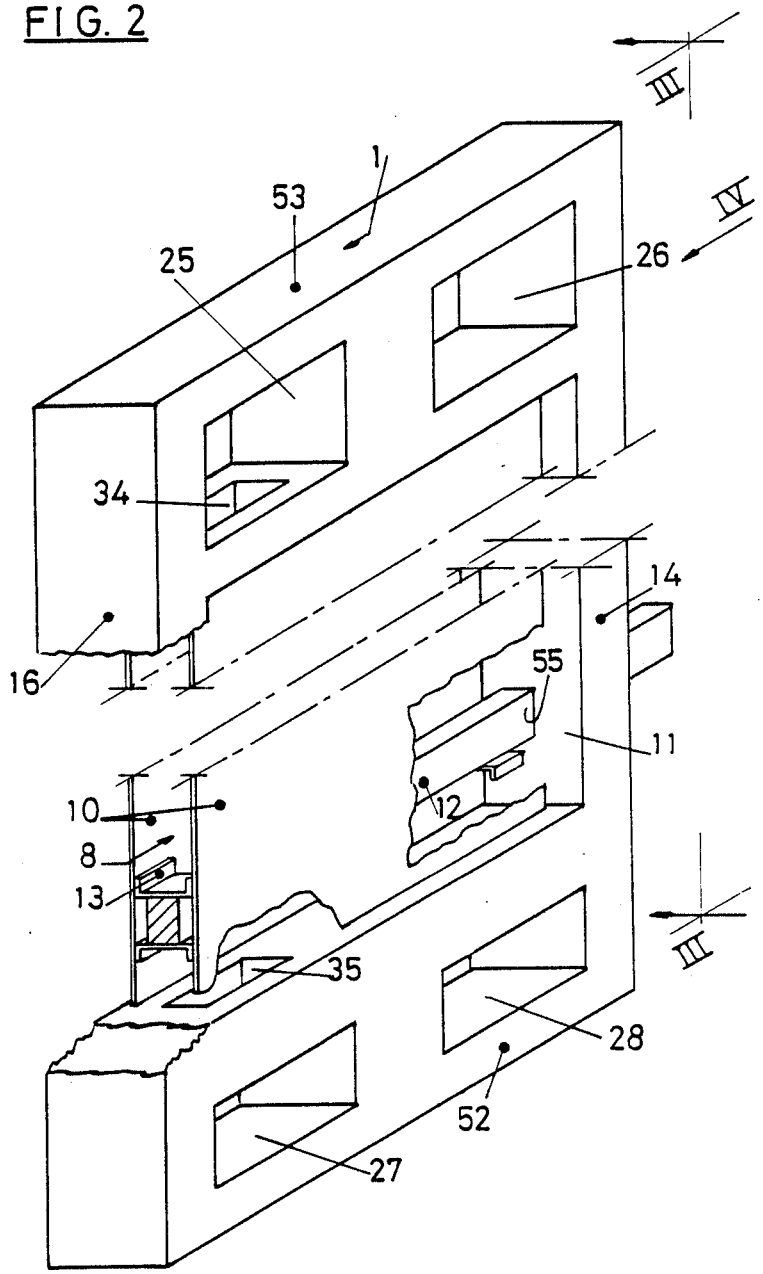
FIG. 2 is an axonometric perspective view with partial cutaway of a unit of the electrolyser of FIG. 1.
Figure 3:
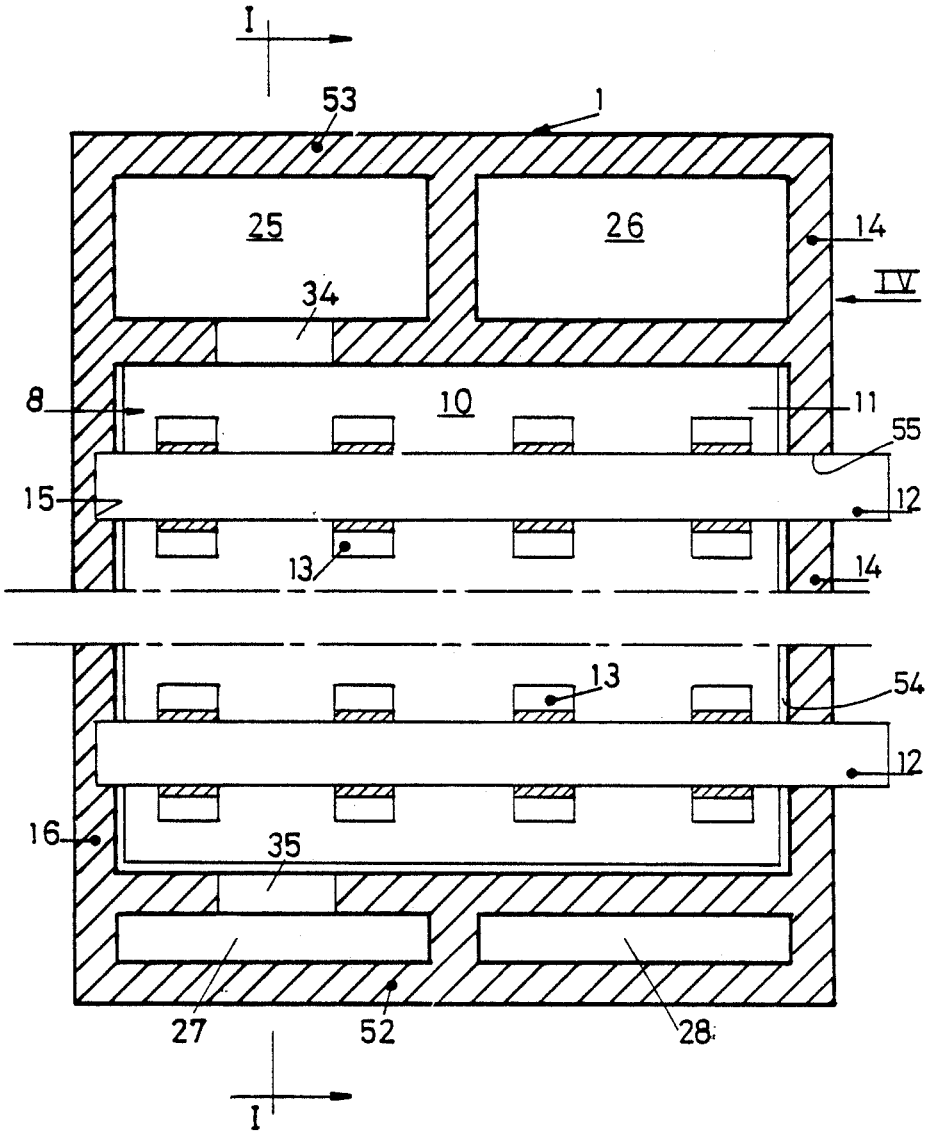
FIG. 3 shows the unit of FIG. 2 in vertical cross-section along the plane III—III of FIG. 2.
Figure 4:
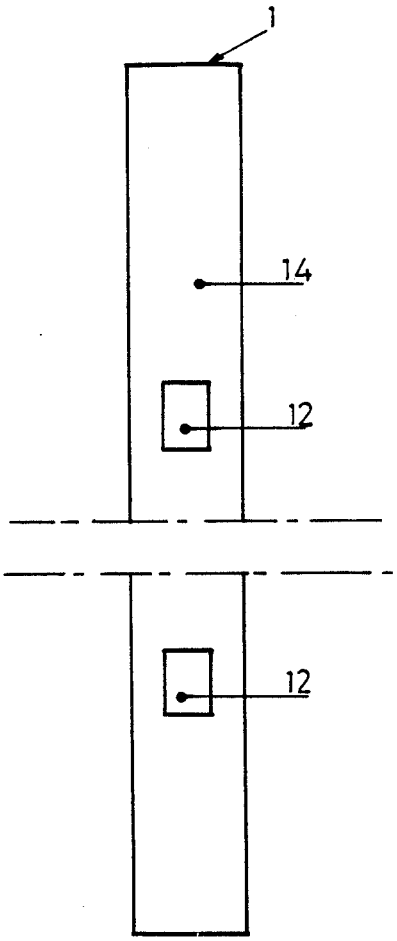
FIG. 4 is a side-view of the unit of FIGS. 2 and 3, in the direction of the arrow IV of FIG. 2.

FIGS. 2, 3 and 4 show an anode frame 1 associatd with an anode 8. In accordance with the invention, the frame 1 is deployed freely at the periphery of the anode 8, which for this purpose consists of two vertical rectangular metal plates 10, arranged facing each other inside the opening 11 of the frame 1. The two plates 10 are integrally attached to horizontal metal bars 12 by means of U-shaped fixing lugs 13. The bars 12 pass in a leakproof manner through cylindrical openings 55 made in a vertical upright 14 of the frame 1 and are lodged in slots 15 in the other upright 16 of the frame, so as to centre the anode in the frame. The height and the width of the plates 10 are chosen so as to be approximately equal to, although slightly smaller than, the height and the width of the opening 11 in the frame 1, so that the anode 8 thus forms a supporting structure for the frame 1, while providing a small gap 54 between itself and the frame. The bars 12 are extended beyond the upright 14, outside the opening 11, in order to be connected to a bus bar, not shown, coupled to the positive terminal of a source of direct current. The bars 12 thus simultaneously form electrical conductors for the anode 8 and members for local fastening of the anode 8 to the frame 1.

Figure 5:
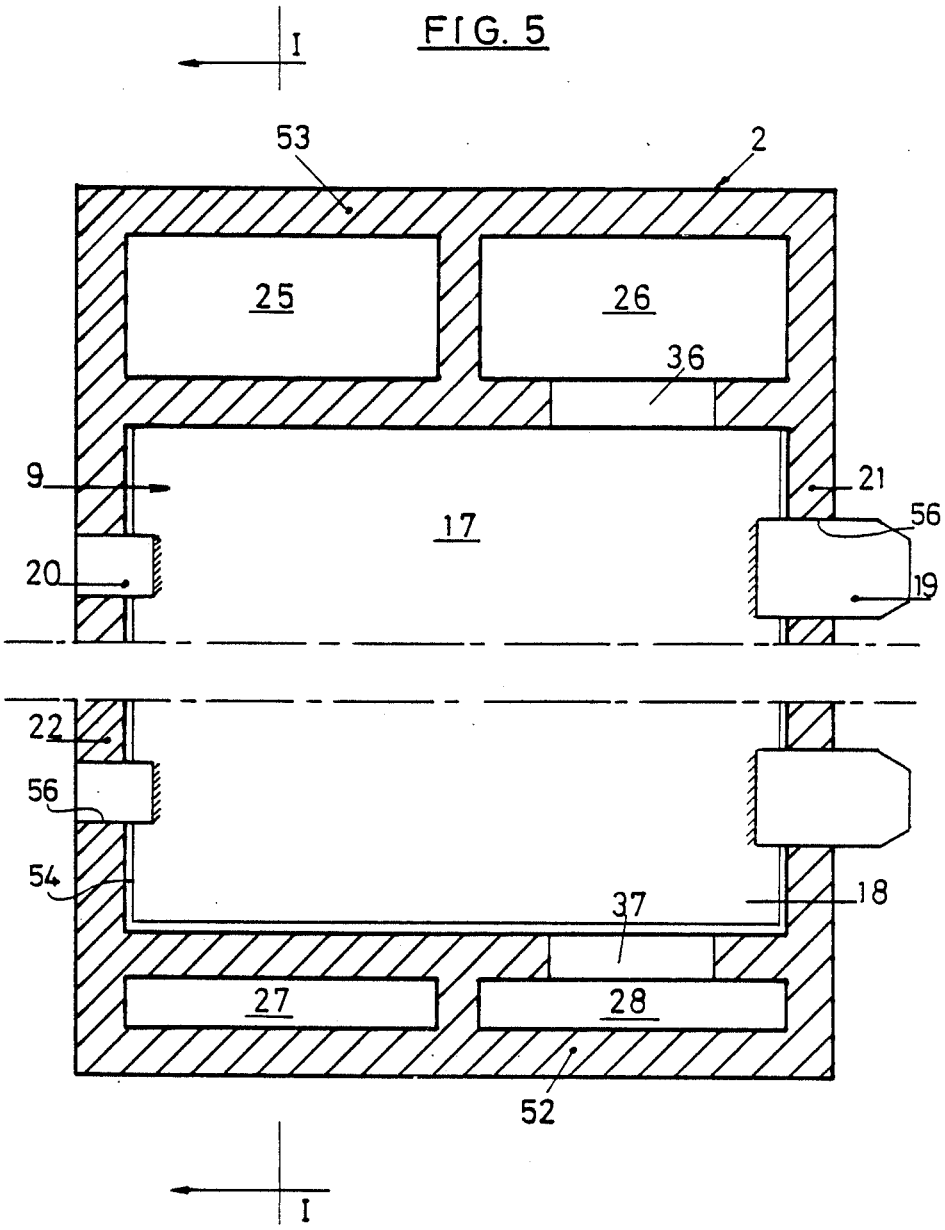
FIG. 5 shows another unit of the electrolyser of FIG. 1, in vertical section along the plane V—V of FIG. 1.

The cathodes 9 are associated in a similar manner with the cathode frames 2, for which they also form a supporting structure. To this end, they also comprise a pair of vertical rectangular metal plates 17 arranged opposite each other inside the opening 18 in the frame 2 (FIGS. 1 and 5). The plates 17 have a height and a width which are approximately equal to, although slightly smaller than, the height and the width of the opening 18 in the frame 2, and are centred in the latter by means of small bars or tenons 19 and 20 welded to the plates and lodged in corresponding openings 56 made in the uprights 21 and 22 of the frame. Also serving as electrical conductors for the cathode 9, the small bars 19 are extended outside the frame 2 to be connected to a bus bar coupled to the negative terminal of the source of current.

In the electrolyser of FIGS. 1 to 5, the connection of the anode bars 12 and of the small cathode bars 19 to their respective bus bars is made by means of flexible conductors consisting of plaited metal strands, so as not to hinder a free displacement of the stack of frames.

The plates 10 and 17, which form the electrodes, are prefereably perforated; they may, for example, be metal sheets perforated with openings, sheets of expanded metal or rigid wire networks.

In accordance with the invention, the frames 1 and 2 and the membranes 5 are compressed between the flanges 3 and 4 by means of tie rods 23, and the sealing of the assembly is ensured by virtue of the elastic deformation of the frames 1 and 2, without the need for additional seals. By virtue of the gaps 54 provided between the plates 10 and 17 of the electrodes and their respective frames 1 and 2, the latter can swell transversely without being hindered by the electrodes, when they are compressed between the flanges 3 and 4.

Figure 6:
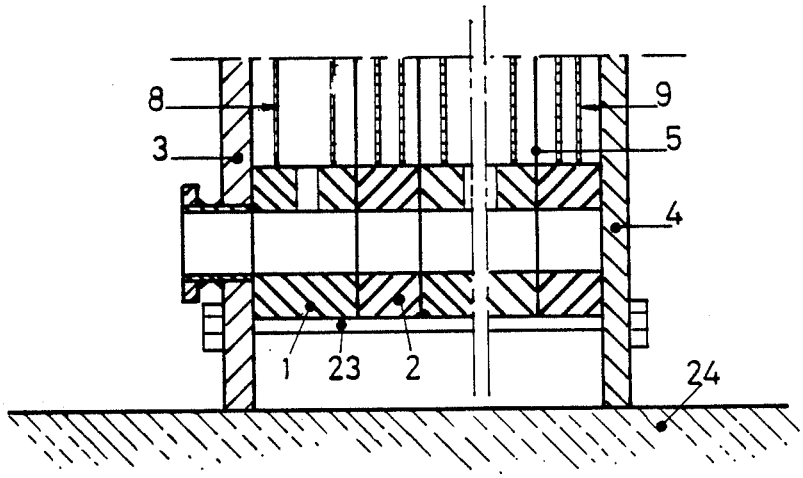
FIG. 6 is a partial view, in vertical lengthwise section, of an alternative embodiment of the electrolyser of FIG. 1.

In the embodiment shown in FIG. 1, only the flanges 3 and 4 rest on the pedestal 24, while the frames 1 and 2 and the electrodes 8 and 9 are held away from the pedestal by the frictional forces generated between the frames and the flanges. In an alternative form, in the case of electrolysers containing a large number of flexible frames and the flanges. In an alternative form, in the case of electrolysers containing a large number of flexible frames, one or more intermediary supports may be provided for the frames. The tie rods 23 may advantageously serve for this purpose, as shown diagrammatically in FIG. 6.

The frames 1 and 2 and the membranes 5 are perforated with four marginal openings 25, 26, 27 and 28 which, when aligned in the electrolyser, form, respectively, four separate horizontal collectors which open out, respectively, into four openings 33 made through the flange 3. These collectors serve to permit the entry of the electrolytes to be electrolysed into the electrolysis chambers 6 and 7 and for the removal of the products of electrolysis. To this end, in the anode frames 1, the marginal openings 25 and 27 are in communication with the central opening 11, via lines 34 and 35 and, in the cathode frames 2, the marginal openings 26 and 28 are in communication with the central opening 18 via lines 36 and 35.

Figure 7:
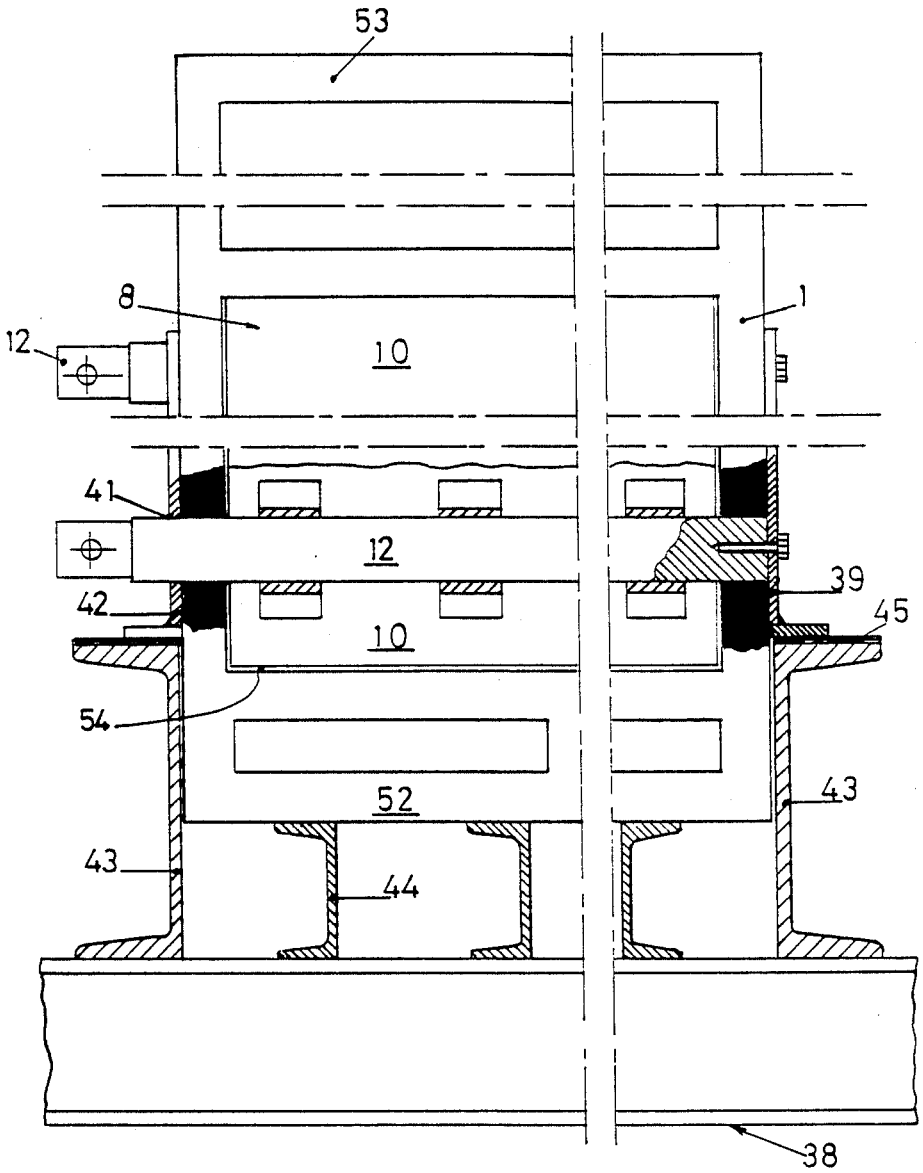
FIG. 7 shows a second embodiment of the electrolyser according to the invention, in vertical cross-section with partial cutaway.

FIG. 7 relates to another embodiment of the electrolyser according to the invention, in which the anode frames 1 are suspended from the anodes 8 and the latter are supported on a metal framework 38. To this end, each anode frame 1 is arranged around the pair of plates 10 forming the anode 8, as described earlier with reference to FIGS. 1 to 4, the bars 12 have one end fastened to a transverse support plate 39 by means of screws or bolts 40, the other end of the bars is lodged in an appropriate opening 41 of another transverse support plate 42, and the plates 39 and 42 rest on small horizontal beams 43 of the framework 38. Insulators 45 are inserted between the small beams 43 and the plates 39 and 42. The cathode frames 2 and their cathodes 9 are held in the stack by compression between the anode frames, as in the embodiment in FIGS. 1 to 5.

If appropriate, the framework 38 may comprise additional small beams 44 serving as intermediary supports for the frames.

Figure 8:
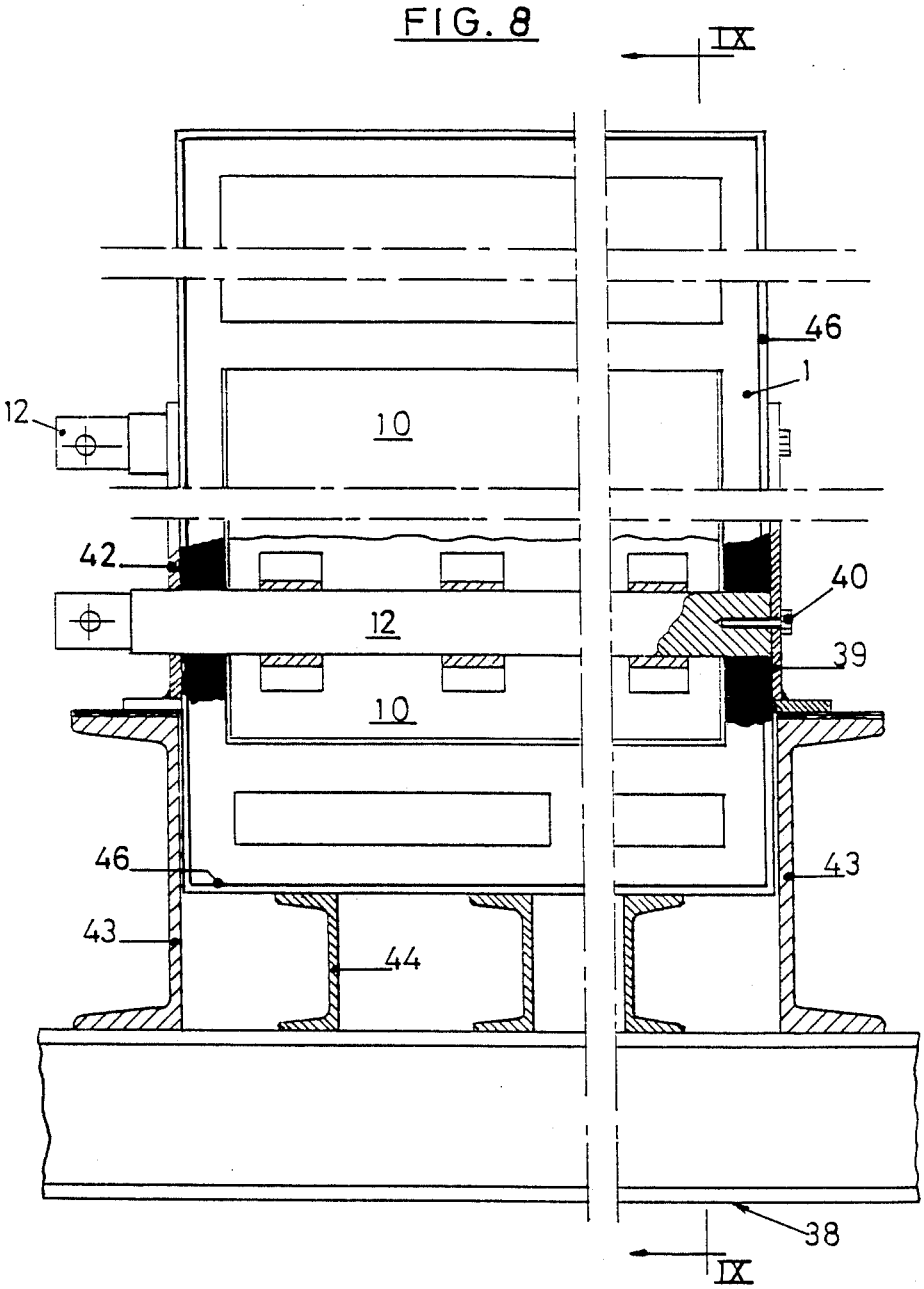
FIG. 8 is a view similar to FIG. 7, of an alternative form of the embodiment of FIG. 7.
Figure 9:
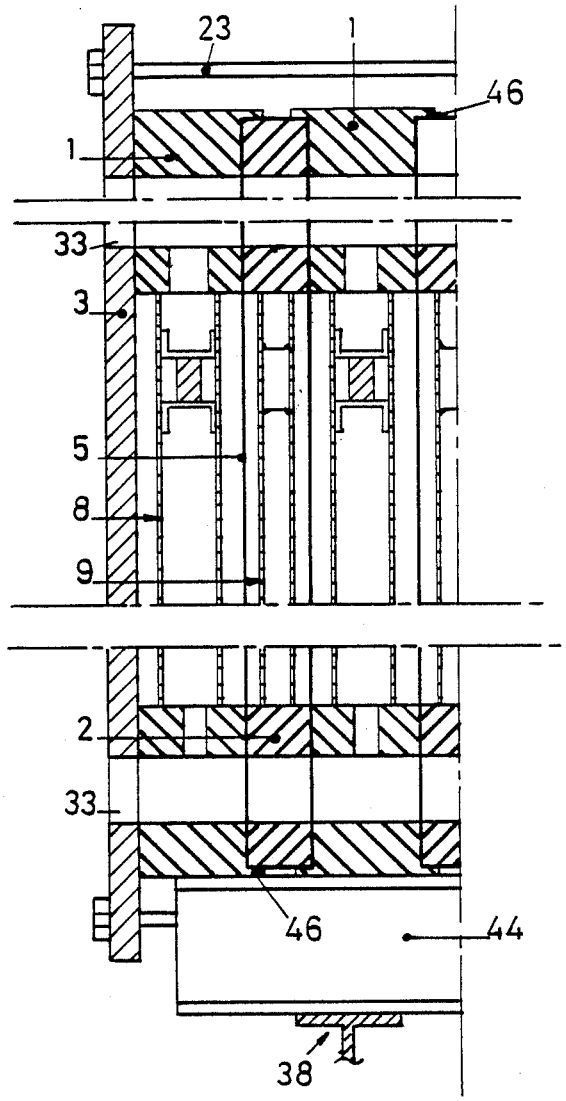
FIG. 9 is a section along the plane IX—IX of FIG. 8.

In an alternative form of this embodiment, shown in FIGS. 8 and 9, the anode frames 1 have a peripheral rib 46 which surrounds the cathode frames 2 and is used to support them and to centre them in the stack.

In the embodiments of the electrolyser according to the invention which are shown in FIGS. 1 to 9, reinforcements, not shown, may, if appropriate, be embedded in the lower 52 and/or upper 53 side parts of the anode frames 1 and cathode frames 2. The purpose of these reinforcements is to increase the flexural strength of the sideparts 52 and/or 53 of the frames. They may consist, for example, of metal bars or rods.

In the case where the electrolyser according to the invention, shown in FIGS. 1 to 9, is intended for the electrolysis of aqueous sodium chloride solutions, the plates 10 of the anodes 8 may be made, in a manner known per se, of titanium and may carry a coating of an active material for discharging the chloride ions, such as a mixture of ruthenium oxide and titanium dioxide, for example. The bars 12 may be made of titanium. Bars produced by coextrusion of a copper core in a titanium sheath are advantageously used. The plates 17 of the cathodes 9 may be made of any appropriate material, for example steel or nickel.

In the use of membrane electrolysers for the production of chlorine and of aqueous sodium hydroxide solutions it has generally been found advantageous to maintain a pressure in the cathode chambers which is higher than that prevailing in the anode chambers. The embodiments shown diagrammatically in FIGS. 10 to 12 are specially designed for this way of using the electrolyser, so as to avoid local corrosion of the anode frames when the latter are made of a copolymer derived from ethylene and propylene.

Figure 10:
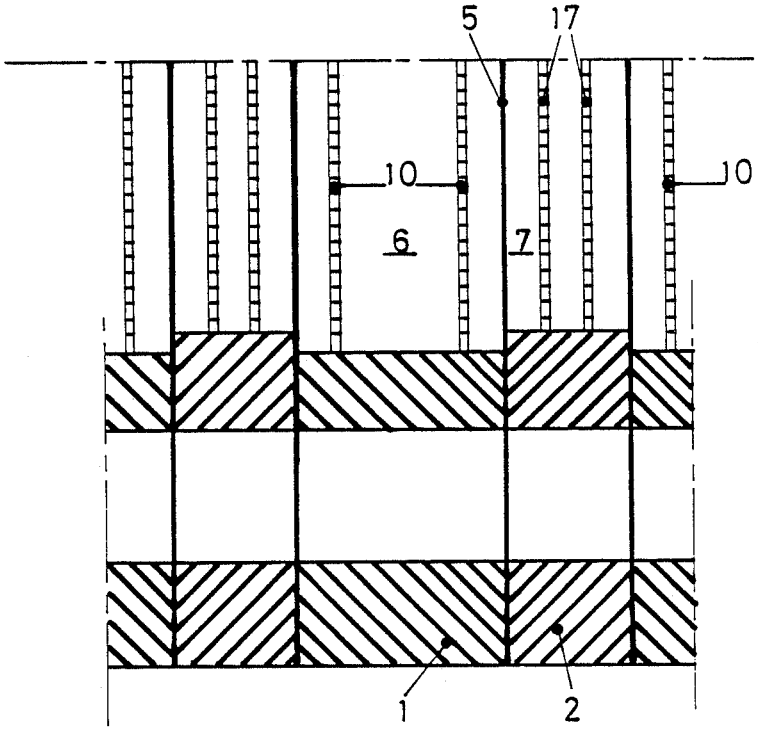
FIG. 10 is a partial view similar to FIG. 9, on a larger scale, of a detail of the electrolyser according to the invention.

In the embodiment shown in FIG. 10, the anode frames 1 are set back in relation to the cathode frames 2, inside the electrolyser.

Figure 11:
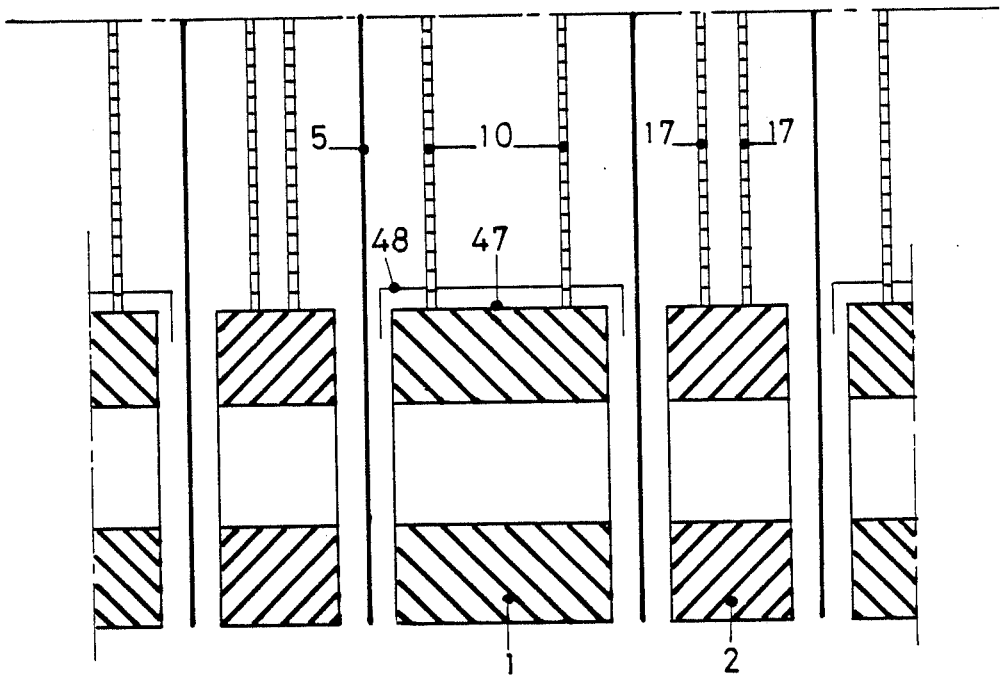
FIG. 11 is an exploded partial view of another detail of the electrolyser according to the invention.
Figure 12:
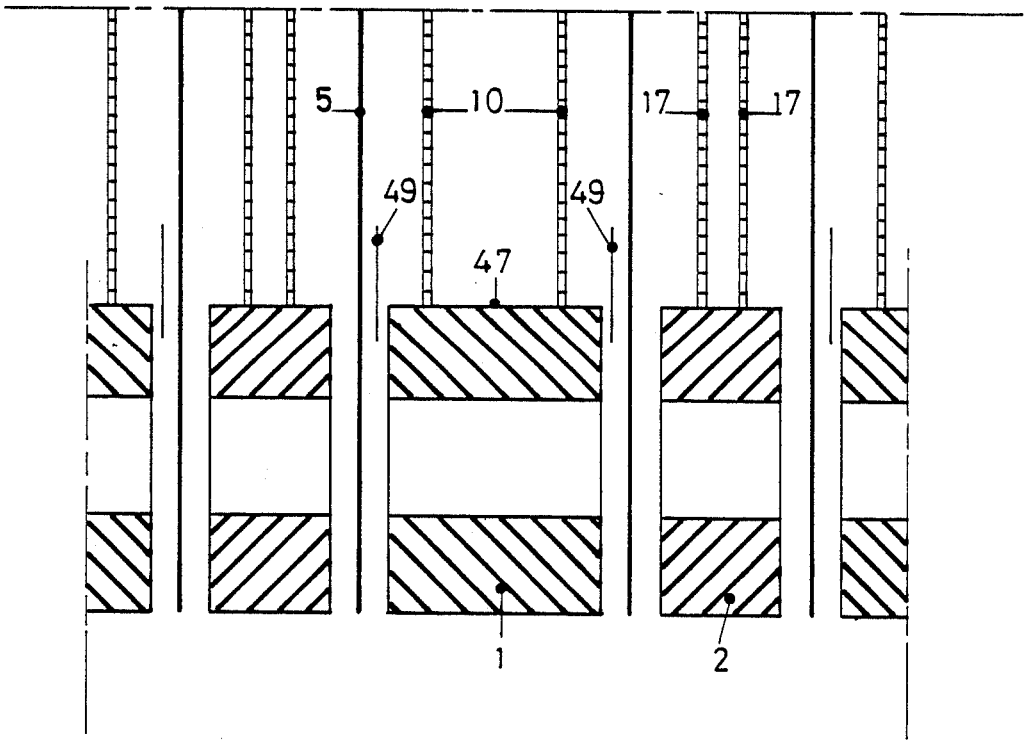
FIG. 12 is an exploded partial view of an alternative form of construction of the detail of FIG. 11.

In the embodiment shown in FIG. 11, the face 47 defining the central opening 11 of the anode frames 1 is enclosed in a sheet 48 made of a fluoro, preferably perfluoro, polymer such as a polytetrafluoroethylene. In an alternative form of this embodiment of the electrolyser according to the invention, shown in FIG. 12, the enclosure 48 of FIG. 11 is replaced by two annular sheets 49 which project forward of the face 47, inside the anode chamber 6.

Figure 13:
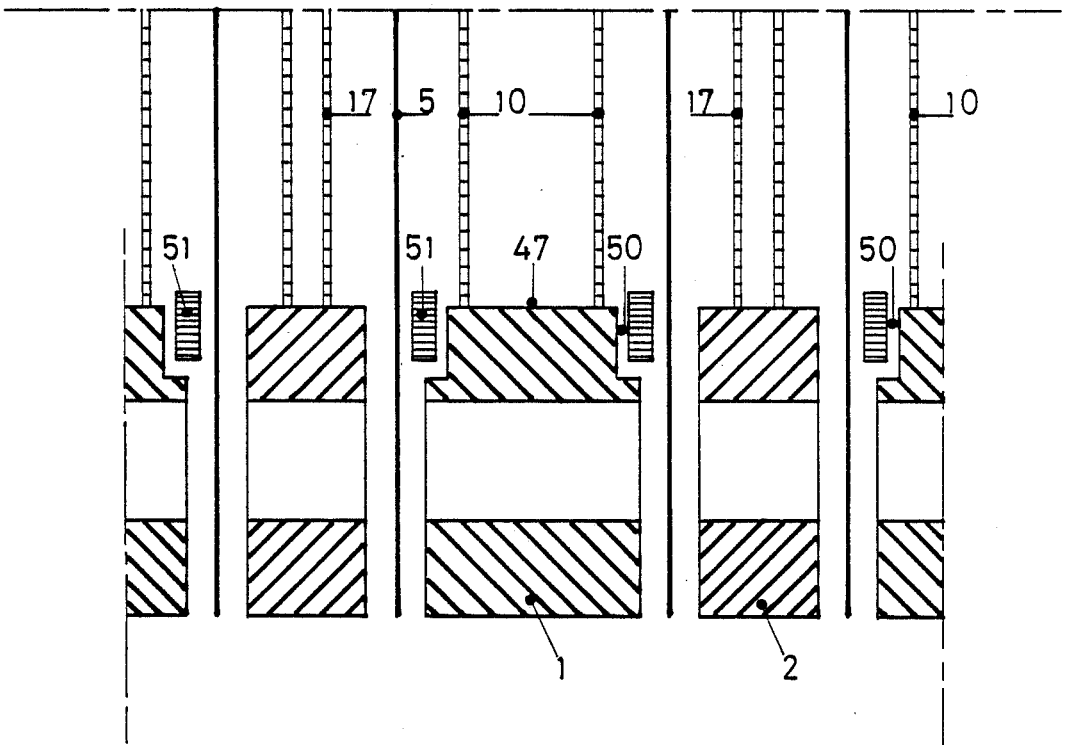
FIG. 13 is an exploded partial view of another alternative form of construction of the detail of FIG. 11.

In the embodiment shown in FIG. 13, each anode frame 1 has two annular peripheral cutouts 50 which open into the anode chamber opposite the membranes, and rings 51 made of a fluoro polymer such as polytetrafluoroethylene are housed in these cutouts 50.

I claim:

1. Electrolyser of the filter press type comprising a stack of vertical frames defining electrolysis chambers, vertical electrodes in said chambers, rigid members at the ends of said stack and tension means for drawing said end members toward one another to compress said frames between them, said frames being formed of elastically deformable material and freely surrounding respective electrodes to permit lateral expansion of said frames when compressed between said end members, and means locally interconnecting said electrodes with respective frame, only at spaced intervals distributed around the peripheries of said electrodes to position said electrodes with respect to said frames while permitting lateral expansion of said frames.

2. Electrolyser according to claim 1, characterized in that the material of the frames (1,2) is an elastomer which has a Shore A hardness of between 40 and 90 units.

3. Electrolyser according to claim 1, characterized in that an individual frame (1,2) is associated with an individual electrode (8,9).

4. Electrolyser according to claim 1 characterized in that said means for locally interconnecting said electrodes (8,9) with said frames (1,2) comprise tenons (12,19,20) fixed to the electrodes (8,9) and engaged in corresponding slots (15,55,56) in the frames (1,2).

5. Electrolyser according to claim 4, characterized in that said tenons comprise rigid metal bars (12) which pass through cylindrical openings (55) arranged in the frames (1) and which simultaneously form electrical conductors for the electrodes (8).

6. Electrolyser according to claim 5 characterized in that the electrodes (8) are supported by the electrical conductors (12) on a support (39,42,43), and the frames (1) are supported by the electrodes (8).

7. Electrolyser according to claim 1, characterized in that the respective dimensions of the frames (1,2) and of the electrodes (8,9) are adjusted so as to provide a substantial gap (54) between at least a part of the peripheral edge of the electrodes (8,9) and the frames (1,2).

8. Electrolyser according to claim 1, characterized in that said end members are placed on a pedestal (24), and the electrodes (8,9) and the frames (1,2) are supported above the pedestal (24) by the frictional forces generated between the frames (1,2) and said end members (3,4).

9. Electroliser according to claim 1, in which said interconnecting means comprises a metal bar fixed to said electrode and extending in fluid-tight manner out through a hole in said frame, said bar comprising an electrical connection for said electrode.

10. Electroliser according to claim 9, further comprising means external of said frame for supporting said metal bar.

11. Electroliser according to claim 1, in which said means interconnecting said electrodes and respective frames comprise means for supporting said frames.

* * * * *